US011686311B1

(12) United States Patent
Lu et al.

(10) Patent No.: US 11,686,311 B1
(45) Date of Patent: Jun. 27, 2023

(54) DRIVE SHAFT CONNECTOR WITH COUNTERWEIGHT AND BLADES FOR COOLING PUMP MOTOR

(71) Applicant: Agilent Technologies, Inc., Santa Clara, CA (US)

(72) Inventors: Vannie Lu, Billerica, MA (US); George Galica, Worcester, MA (US); Aileen Cheang, Shirley, MA (US)

(73) Assignee: Agilent Technologies, Inc, Santa Clara, CA (US)

( * ) Notice: Subject to any disclaimer, the term of this patent is extended or adjusted under 35 U.S.C. 154(b) by 0 days.

(21) Appl. No.: 17/834,858

(22) Filed: Jun. 7, 2022

(51) Int. Cl.

| | |
|---|---|
| ***F04C 29/00*** | (2006.01) |
| ***F04C 18/02*** | (2006.01) |
| ***F04C 29/04*** | (2006.01) |
| ***F04C 15/00*** | (2006.01) |
| ***F04C 19/00*** | (2006.01) |

(52) U.S. Cl.
CPC ..... *F04C 29/0057* (2013.01); *F04C 15/0057* (2013.01); *F04C 15/0061* (2013.01); *F04C 15/0073* (2013.01); *F04C 18/0215* (2013.01); *F04C 29/04* (2013.01); *F04C 29/045* (2013.01); *F04C 2240/40* (2013.01); *F04C 2240/60* (2013.01); *F04C 2240/807* (2013.01)

(58) Field of Classification Search
CPC .. F04C 29/0057; F04C 18/0215; F04C 29/04; F04C 15/0057; F04C 15/0061; F04C 15/0073; F04C 15/0096; F04C 29/042; F04C 29/045
See application file for complete search history.

(56) References Cited

U.S. PATENT DOCUMENTS

| | | | | |
|---|---|---|---|---|
| 5,842,843 | A | 12/1998 | Haga | |
| 8,007,260 | B2 | 8/2011 | Yanagisawa | |
| 9,097,252 | B2 | 8/2015 | Schofield et al. | |
| 9,341,186 | B2 | 5/2016 | Calhoun | |
| 2007/0077159 | A1* | 4/2007 | Tsuchiya | F04C 29/04 418/83 |
| 2015/0078927 | A1 | 3/2015 | Forni | |
| 2017/0089624 | A1* | 3/2017 | Yokoyama | F04C 29/028 |
| 2018/0355866 | A1 | 12/2018 | Bahrami et al. | |

FOREIGN PATENT DOCUMENTS

| | | | | |
|---|---|---|---|---|
| CN | 2821227 | * | 9/2006 | F04C 18/02 |
| CN | 207420985 U | | 5/2018 | |
| CN | 212563844 U | | 2/2021 | |

OTHER PUBLICATIONS

English translation of CN2821227 by PE2E Sep. 30, 2022.*

* cited by examiner

*Primary Examiner* — Deming Wan

(57) ABSTRACT

A fluid pump includes a pump head and a motor coupled by a drive shaft. The pump head includes a pump inlet, a pump outlet, and a pumping stage in which a movable pump element is driven by the drive shaft. The motor includes a motor rotor and a motor stator. A connector couples the motor rotor and the drive shaft. The connector includes a plate rotatable with the drive shaft, fan blades attached to the plate for establishing a flow of air for cooling the motor, and one or more counterweights attached to the plate for reducing or eliminating imbalance created by certain forces generated by the pump during operation.

20 Claims, 6 Drawing Sheets

DRIVE SHAFT CONNECTOR WITH COUNTERWEIGHT AND BLADES FOR COOLING PUMP MOTOR

TECHNICAL FIELD

The present invention relates to pump assemblies, and particularly to pump assemblies that include features providing counterbalancing and cooling.

BACKGROUND

Many types of pumps generally include a pump head coupled to a prime mover by a rotating drive shaft or by two shafts coupled to each other (e.g., a prime mover shaft and a pump shaft). The pump head typically includes one or more movable pump elements that move relative to a stationary portion (a pump stator) of the pump head in a manner that pumps a working fluid (liquid or gas) from a pump inlet to a pump outlet, either for compressing or pressurizing the working fluid or for evacuating an enclosed space communicating with the pump inlet (by removing fluid from the enclosed space). The prime mover, often an electric motor, generates the power utilized for moving the movable pump elements. As an electric motor, the prime mover typically includes a motor rotor coupled to the drive shaft that rotates relative to a motor stator. The motor rotor and the motor stator typically include electrically conductive windings, electromagnets and/or permanent magnets configured to couple the motor rotor and the motor stator by a magnetic field. Electrical power supplied to the windings or magnet(s) of the motor stator or motor rotor generates a magnetic field that couples the motor stator and the motor rotor as a magnetic circuit and thereby induces rotation of the motor rotor. The drive shaft transfers the as-generated power (in particular, torque) from the motor rotor to the movable pump elements. Various types of pumps have one or more movable pump elements that require such power, such as scroll pumps, rotary vane pumps, gear pumps, screw pumps, Roots-type pumps, claw pumps, impeller pumps, fans, piston pumps, etc.

Depending on the type of pump, a pump may include one or more counterweights positioned to rotate with the drive shaft. The counterweight(s) may be necessary to counterbalance forces imparted by moving components of the pump that cause imbalance, whereby the counterweight(s) stabilize the operation of the pump.

Additionally, a pump may include a cooling system configured to remove heat from heat-generating parts of the pump (e.g., heat generated by friction or shear of moving components, heat generated from the work of compressing the working fluid, resistive heat generated by the motor, etc.). Such a cooling system may include one or more fans positioned in one or more flow paths for drawing ambient air into the interior of the pump, directing the flow of air through the pump interior to pick up and carry heat energy away from the pump, and exhausting the heated air from the pump. The cooling system may also include one or more sets of cooling fins positioned at appropriate locations on and/or in the pump to increase the surface areas (of internal and/or external surfaces) from which heat may be removed. As an alternative to utilizing air as the cooling medium, the cooling system may be configured to circulate a liquid coolant, in which case the cooling system may require an evaporating stage, a condensing stage, and a separate pump for moving the coolant through the cooling system. Alternatively or in addition to providing a cooling medium that travels along flow paths, a pump may include one or more heat pipes containing an internal cooling medium and positioned at appropriate locations in the pump interior. Alternatively or in addition to providing a cooling system, various components may be added to a pump to increase the thermal isolation of heat-generating parts of the pump.

When it is desired to enhance the cooling capability of the pump, additional components (e.g., fans) may be added to the existing cooling system, the existing cooling system may be replaced with another cooling system having greater capacity for heat transfer, or another cooling system may be added (in addition to the existing cooling system), and/or additional means for thermal isolation may be added. Such solutions may significantly increase the cost, complexity, power consumption, noise, and/or size of the fluid pump.

There is an ongoing need for further developments in the field of pump design, including for providing counterweights and cooling features.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

In one aspect of the present disclosure, a connector is provided for a fluid pump. The connector is configured to provide a combination of two or more functions. First, the connector connects, or couples, a drive shaft to a motor rotor of the fluid pump. Second, the connector may counterbalance an imbalance created by forces generated by the fluid pump during operation. Third, the connector may circulate air in a motor of the fluid pump to cool the motor during operation.

According to a non-exclusive embodiment, a fluid pump includes: a pump head comprising a pump inlet, a pump outlet, and a pumping stage comprising a movable pump element, wherein the pumping stage is configured to pump a fluid from the pump inlet to the pump outlet in response to movement of the movable pump element; a motor comprising a motor rotor and a motor stator; a drive shaft comprising a front shaft end and a rear shaft end, wherein the front shaft end is coupled to the movable pump element, the rear shaft end is coupled to the motor rotor, the motor rotor is configured to drive rotation of the drive shaft about a drive axis, and the drive shaft is configured to drive movement of the movable pump element; and a connector coupling the motor rotor and the rear shaft end, wherein the connector comprises a plate rotatable about the drive axis, a plurality of fan blades attached to the plate, and a counterweight attached to the plate.

According to another non-exclusive embodiment, a method for operating a fluid pump includes: a providing a fluid pump according to any of the embodiments disclosed herein; and rotating the connector and the drive shaft by operating the motor, wherein the drive shaft drives the movement of the movable pump element, and wherein, during the rotating, the counterweight reduces an imbalance in forces generated by the fluid pump, and the fan blades establish a flow of air around the motor that is effective to remove heat from the motor.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

Figure 1:
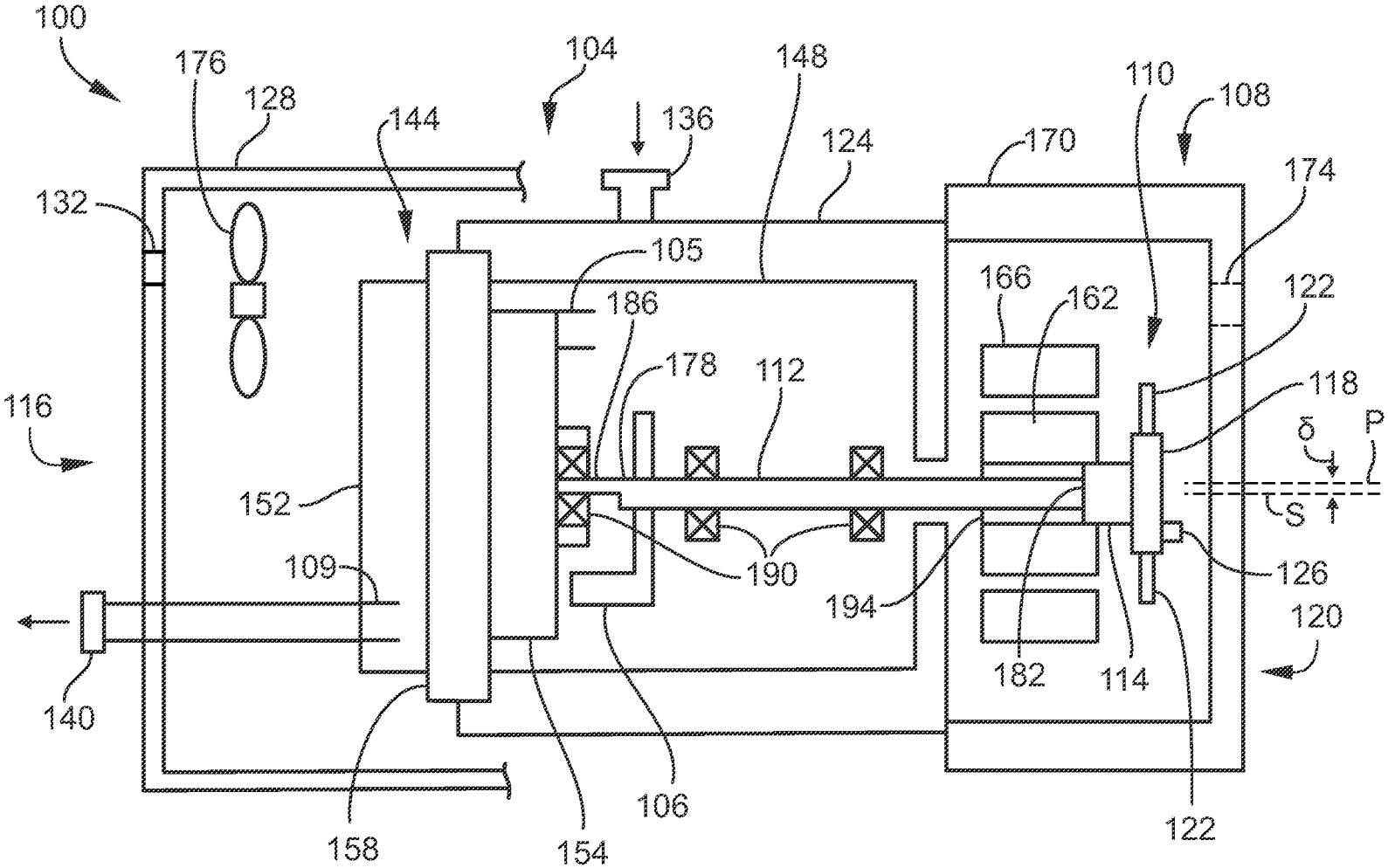
FIG. 1 is a schematic longitudinal side view of an example of a fluid pump according to an embodiment of the present disclosure.

The illustrations in all of the drawing figures are considered to be schematic, unless specifically indicated otherwise.

DETAILED DESCRIPTION

In this disclosure, all "aspects," "examples," and "embodiments" described are considered to be non-limiting and non-exclusive. Accordingly, the fact that a specific "aspect," "example," or "embodiment" is explicitly described herein does not exclude other "aspects," "examples," and "embodiments" from the scope of the present disclosure even if not explicitly described. In this disclosure, the terms "aspect," "example," and "embodiment" are used interchangeably, i.e., are considered to have interchangeable meanings.

In this disclosure, the term "substantially," "approximately," or "about," when modifying a specified numerical value, may be taken to encompass a range of values that include+/−10% of such numerical value.

FIG. 1 is a schematic view of an example of a fluid pump (or pump assembly, or pumping assembly) 100 according to an embodiment of the present disclosure. The fluid pump 100 generally includes a pump head (assembly) 104, a motor (assembly) 108, and a drive shaft 112 rotatable about a drive axis S. Depending on the embodiment, the fluid pump 100 may be configured to operate as a vacuum pump or a fluid compressor. Generally, previously known components, structures, functions, and operations of fluid pumps of the types described herein are understood by persons skilled in the art, and thus need not be described in detail herein. Accordingly, certain components of the fluid pump 100 are described only briefly herein to provide a relevant context for the presently disclosed subject matter.

For reference and description, the fluid pump 100 is considered to have a longitudinal device axis coincident with the drive axis S relative to which various components of the fluid pump 100 are positioned. The drive axis S (or device axis) is not necessarily the geometrical center axis of the fluid pump 100. In the context of the present disclosure, the terms "axial" and "axially" are considered to be relative to the drive axis S (or device axis), unless specified otherwise or the context dictates otherwise. Also for reference and description, the fluid pump 100 is considered to generally have a front end (or front side) 116 and a rear end (or rear side) 120 axially opposite to the front end 116. The pump head 104 is closer to the front end 116 than the motor 108, and the motor 108 is closer to the rear end 120 than the pump head 104. The "front" end (or front side) of any component of the fluid pump 100 is considered to be the end or side facing generally toward the front end 116. The "rear" end (or rear side) of any component of the fluid pump 100 is considered to be the end or side facing generally toward the rear end 120. From the perspective of FIG. 1, the front end 116 is on the left and the rear end 120 is on the right. However, the fluid pump 100 is not limited to any particular orientation relative to a horizontal plane (e.g., the ground or surface on which the fluid pump 100 rests) or a vertical plane, or relative to any other reference datum.

The pump head 104 may include a structural frame (or housing) 124, which may have a single-piece configuration or be an assembly of two or more frame sections. Various pump components may be attached to or integral with, and/or enclosed by, the frame 124. The pump head 104 may also include an outer cowling 128 (only partially shown in FIG. 1), which may have a single-piece configuration or be an assembly of two or more cowling sections. The cowling 128 may enclose at least part of the axial length of the pump head 104. In some embodiments, a pump base (not shown) supporting the pump head 104 may cooperate with the cowling 128 to fully enclose the pump head 104. The cowling 128 may include one or more openings as needed to accommodate one or more fluid conduits, electrical wiring, etc., one or more vents 132 for allowing air flow into or out from the interior of the pump head 104, etc.

The pump head 104 further includes a pump inlet (working fluid inlet) 136, a pump outlet (working fluid outlet) 140, and one or more pumping stages 144. The pump inlet 136 may fluidly communicate with any source of a working fluid (gas or liquid) to be pumped by the fluid pump 100. As examples, a source of working fluid may be a vacuum chamber (a chamber to be evacuated, i.e., pumped down to a sub-atmospheric pressure), a container or pipe containing a fluid to be compressed (and/or to be transported at a desired pressure and/or flow rate), or an open space containing a fluid to be compressed (e.g., ambient air). The pump inlet 136 may schematically represent one or more fluid conducting components (pipes, passages, chambers, valves, etc.) utilized to supply the working fluid to the (first) pumping stage 144. For example, the pump inlet 136 may represent one or more fluid conduits that pass through the frame 124 into an inlet region 148 of the pump head 104 that is on the inlet side of the pumping stage 144. The inlet region 148 may be a low-pressure region. The pump outlet 140 may fluidly communicate with any destination intended to receive the fluid outputted by the pump head 104, such as a container (e.g., pressure vessel) or pipe, a downstream device, a tool or system that utilizes the outputted fluid in a given process, or an open space (e.g., in a case where air or other non-toxic fluid is being evacuated from a vacuum chamber). The pump outlet 140 may schematically represent one or more fluid conducting components (pipes, passages, chambers, valves, etc.) utilized to conduct outputted fluid away from the (last) pumping stage 144. In some examples and as illustrated, the pump outlet 140 communicates with an outlet region 152 of the pump head 104 that is on the outlet side of the pumping stage 144. The outlet region 152 may be a high-pressure region. In the context of this disclosure, the terms "low-pressure" and "high-pressure" are relative to each other. That is, fluid pressure in the low-pressure region is lower than the fluid pressure in the high-pressure region, and vice versa.

The pumping stage(s) 144 include one or more movable pump elements 154 that move relative to one or more stationary pump components, or pump stators 158. Generally, the pumping stage(s) 144 are configured to pump the working fluid from the pump inlet 136 to the pump outlet 140 in response to movement of the movable pump element(s) 154. The movable pump element(s) 154 cooperate with the pump stator(s) 158 to perform work on the working fluid. The movable pump element(s) 154 and the pump stator(s) 158 cooperatively define one or more fluid flow paths through which the working fluid is conducted (pumped) through the pumping stage(s) 144, as appreciated by persons skilled in the art. In the illustrated example, the pump head 104 includes a single pumping stage 144 (i.e., with a single movable pump element 154).

Depending on the type of movable pump element 154, its movement may involve any combination of orbiting, rotation, and/or linear translation in any or all of six degrees of freedom. Examples of the movable pump element 154 include, but are not limited to, an orbiting scroll, a rotary vane component, a crank, a cam, a gear, a screw, a Roots rotor (e.g., lobe), a claw, an impeller, a compressor wheel, a fan, and a piston, all of which are generally understood by persons skilled in the art.

Generally, the pump stator 158 may be any stationary portion of the pump head 104 configured to interface with the movable pump element 154 to generate a pumping action on the working fluid. In the present example, the pump stator 158 is attached to, or is an integral part of, the frame 124.

In an example, the pumping stage 144 is considered to include a pumping stage inlet 105 and a pumping stage outlet 109. Hence, the pumping stage 144 is configured to pump the working fluid from the pumping stage inlet 105 to the pumping stage outlet 109. The pumping stage inlet 105 may fluidly communicate with the pump inlet 136 via an intermediate structure, such as the structure defining the inlet region 148. The pumping stage outlet 109 may fluidly communicate with the pump outlet 140 via an intermediate structure, such as the structure defining the outlet region 152. As non-exclusive examples, the pumping stage inlet 105 may be one or more inlet ports of the movable pump element 154, and the pumping stage outlet 109 may be one or more outlet ports of the pump stator 158 (or of the outlet region 152, if provided).

Generally, the motor 108 is configured to generate rotational power and transfer it to the drive shaft 112, which in turn transfers the power to the movable pump element 154 via an appropriate mechanical interface that either rotates the movable pump element 154 directly about the drive axis S or converts the shaft rotation into another type of movement (e.g., orbiting, linear translation, etc.). For this purpose, the motor 108 may be any type of motor suitable for powering a pump head 104 of the types described herein. In a typical example and as illustrated, the motor 108 is an electric motor that includes one or more components communicating with a suitable electrical power input. In a typical example, the motor 108 is a direct-current (DC) brushless motor, but alternatively may be a DC brushed motor or an appropriate type of alternating-current (AC) motor or an inverter-driven motor.

In the illustrated example, the motor 108 includes a motor rotor 162, a motor stator 166, and a motor housing 170 enclosing the motor rotor 162 and motor stator 166. The motor rotor 162 is coupled to the drive shaft 112 in a manner described below. The motor rotor 162 and the motor stator 166 each may have a single-piece configuration or may include separate portions attached to or spaced from each other. Depending on the configuration, the motor rotor 162 and the motor stator 166 include electrically conductive windings, electromagnets, and/or permanent magnets as needed to magnetically couple the motor rotor 162 and the motor stator 166 with a magnetic field. The magnetic field is oriented such that in response to an input of electrical power to the motor rotor 162 or the motor stator 166 (depending on the configuration), the motor rotor 162 rotates about the drive axis S and thereby rotates the drive shaft 112 about the drive axis S. The motor stator 166 typically concentrically surrounds the motor rotor 162 and is spaced from the motor rotor 162 by a radial (and annular) gap (the term "radial" referring a direction orthogonal to the drive axis S). A cylindrical shield (not shown) composed of an electrically insulating and non-magnetic material (e.g., a suitable plastic) may be positioned in the radial gap to protect the motor stator 166 from contaminants (dust, metal particles, other particulates, oil, etc.) that may be present in the vicinity of the drive shaft 112. The motor housing 170 may include one or more openings as needed to accommodate one or more fluid conduits, electrical wiring, etc., one or more vents 174 for allowing air flow into or out from the interior of the motor housing 170, etc. In some examples, the motor housing 170 may be attached to or engaged with the cowling 128, or may be considered as being part of the cowling 128.

In some embodiments, the fluid pump 100 may include additional structures (not shown) that enclose one or more of the components of the pump head 104 and/or the motor 108 in a hermetically sealed manner, as appreciated by persons skilled in the art.

The drive shaft 112 is axially elongated along the drive axis S between a front shaft end 178 and an axially opposing rear shaft end 182 of the drive shaft 112. The front shaft end 178 is coupled to the movable pump element 154, either directly or via an interface appropriate for the embodiment. The rear shaft end 182 is coupled to the motor rotor 162 in a manner described below. The drive shaft 112 may have a single-piece configuration as illustrated, or may be an assembly of two or more shafts. For example, the drive shaft 112 may include a pump head shaft coupled to the movable pump element 154, a motor shaft coupled to the motor rotor 162, and a shaft coupling that couples together the pump head shaft and the motor shaft in a contacting manner (e.g., a mechanical coupling) or a non-contacting manner (e.g., an axial or radial magnetic coupling).

In some embodiments and as illustrated, the movable pump element 154 is not a pump "rotor" in the sense of rotating directly on the drive axis S, but instead is an orbiting pump element such as, for example, an orbiting scroll or a rotary vane-holding element, as appreciated by persons skilled in the art. That is, instead of rotating directly on the drive axis S, the movable pump element 154 is configured to orbit at a radial offset distance around the drive axis S. In this case, the drive shaft 112 at its front shaft end 178 may include (may be integral with or coupled to) an eccentric member (or crank) 186 that is coupled to the movable pump element 154. In FIG. 1, the eccentricity is shown by a central axis P of the movable pump element 154 (and of the eccentric member 186) being radially offset from the drive axis S by an offset distance 6. A non-limiting example of an orbiting pump element in the context of a scroll pump is described further below in conjunction with FIGS. 4 and 5.

The fluid pump 100 typically includes a plurality of bearings located along different axial positions that are configured to support the rotation of the drive shaft 112 or the motion of the movable pump element 154, and/or configured to bear axial (e.g., thrust) forces generated during operation of the fluid pump 100. Such bearings may have any configuration appropriate for their function such as, for example, roller bearings, thrust bearings, bushings, etc. In the illustrated example, the fluid pump 100 includes a number of pump-side bearings 190 and at least one motor-side bearing 194, all of which are attached to (e.g., by press-fitting) the drive shaft 112. In the present example, the motor-side bearing 194 is a cylindrical or sleeve-type bushing.

In some embodiments, the fluid pump 100 may generate forces during operation that may cause force imbalances, which may cause instabilities during operation such as excessive vibration, shaking, etc., of one or more components of the fluid pump 100. Such imbalances may thus lead to premature wear or failure of one or more components of the fluid pump 100, loosening of fasteners, detachment or delamination of components, etc. In particular, orbiting pump components can generate force imbalances. The bearings provided with a pump (e.g., bearings 190 and 194) are not designed to address the problem of force imbalance. In some embodiments and as illustrated, the fluid pump 100 includes a rotatable (front or first) counterweight 106 configured to (fully or partially) counterbalance the imbalance during operation. The counterweight 106 is attached to (e.g., by press-fitting), and hence rotates with, the drive shaft 112. Typically, the counterweight 106 is positioned in the pump head 104 near the movable pump element 154, as illustrated.

In the present embodiment, fluid pump 100 further includes a connector (assembly) 110 that is configured to couple the motor rotor 162 and the drive shaft 112 at the rear shaft end 182. Hence, the connector 110 is rotatable about the drive axis S together with the drive shaft 112 and the motor rotor 162. The connector 110 has, or is positioned in, an overhung configuration. In the context of this disclosure, an "overhung" configuration means that the connector 110 is positioned at the rear side of the motor rotor 162 and motor stator 166, and extends in an axial direction away from the rear shaft end 182 such that a majority of the connector 110 is suspended in the interior of the motor housing 170. Accordingly, in the overhung configuration, the connector 110 is not positioned axially between the movable pump element 154 and the motor 108, and is not positioned in the pump head 104 or at the front side of the motor rotor 162 or motor stator 166. The overhung configuration may provide one or more advantages over a non-overhung configuration. The overhung configuration eliminates couplings of the misalignment load. The overhung configuration also makes the fluid pump 100 more compact overall. The overhung configuration reduces the number of parts required for realizing the functions of counterbalancing and cooling, thereby simplifying the assembly process and reducing cost.

In the present example, the connector 110 includes a hub 114, a base plate 118, a plurality of fan blades 122, and one or more (rear or second) counterweights 126. The hub 114 is positioned on the drive axis S, and may be configured to be attached to the rear shaft end 182 and the motor rotor 162 in any suitable manner. In one non-exclusive example, the hub 114 is fastened to the rear shaft end 182 (e.g., by a threaded bolt inserted through a central bore of the hub 114 and screwed into an inside thread of the rear shaft end 182), and is slid into the motor rotor 162. In some examples, the hub 114 may also engage the motor-side bearing 194. The base plate 118 is integrally adjoined or attached to the hub 114. In some examples, both the hub 114 and the base plate 118 may be considered together as being a "hub" or as being a "plate." In a typical example, the base plate 118 is larger in size than the hub 114 (e.g., the base plate 118 may have a larger area or diameter in the transverse plane orthogonal to the drive axis S, i.e., the plane passing into the drawing sheet).

The fan blades 122 and the counterweight(s) 126 are integrally adjoined or attached to the rear side or the outer perimeter of the base plate 118 (opposite to the hub 114). In the present example, the fan blades 122 are positioned at the outer perimeter of the base plate 118 and extend radially outwardly relative to the drive axis S, and the counterweight(s) 126 are positioned at the rear side the base plate 118. In another example, the fan blades 122 may be positioned at the rear side of the base plate 118 and extend axially outwardly therefrom, and the counterweight(s) 126 may be positioned at outer perimeter of the base plate 118 and extend radially outwardly relative to the drive axis S. In other examples, the fan blades 122 and the counterweight(s) 126 both may be positioned at the rear side, or the fan blades 122 and the counterweight(s) 126 both may be positioned at the outer perimeter.

In one example, the connector 110 has a single-piece construction. That is, the components or features of the connector 110 (hub 114, base plate 118, fan blades 122, and counterweight(s) 126) are integral with each other. In another example, the fan blades 122 are "removably" attached to the base plate 118, meaning that the fan blades 122 may be removed from and subsequently reattached to the base plate 118. Alternatively, the fan blades 122 may be removed from the base plate 118 and subsequently replaced with new fan blades 122. The new fan blades 122 may be configured differently from the previously installed fan blades 122, such as in regard to size, shape, orientation, material composition, and/or weight. In the same or another example, the counterweight(s) 126 are removably attached to the base plate 118. This removability allows different counterweights 126 to be utilized (selected and mounted to the base plate 118) to find an optimized configuration for the counterweight(s) 126 on the connector 110. Different counterweights 126 may be selected in particular based on weight, number, material composition, and relative positioning on the base plate 118, but may also be selected based on size, shape, and/or orientation. Moreover, the entire connector 110 as an assembly may be replaced with a new connector 110 that is configured differently from the previous connector 110 in one or more aspects (e.g., size, shape, orientation, position, material composition, and/or weight of one or more components of the connector 110, and/or the number of fan blades 122 and/or counterweights 126 provided).

The fan blades 122 are configured to establish a flow of ambient air through the interior of the motor 108 (motor housing 170) that is effective to cool (remove heat energy from) heat-generating components of the motor 108 such as the drive shaft 112, the motor rotor 162, the motor stator 166, and the motor-side bearing 194. The fan blades 122 may have any shape, position, and orientation for this purpose. In the present example and as illustrated in FIG. 1, the fan blades 122 extend radially outwardly from the base plate 118. Alternatively, the fan blades 122 may extend axially outwardly from the base plate 118.

In a typical but non-exclusive example, each counterweight 126 provided has a larger weight than each of the fan blades 122. In another example, the multiple counterweights 126 provided have a total weight greater than the total weight of the fan blades 122.

In an example, the counterweight 126 may have a fan blade-shaped configuration. In other words, the counterweight 126 may have the same shape as the fan blades 122 and thus likewise function as a fan blade, even if such counterweight 126 differs in other aspects such as size, weight, etc. For example, the counterweight 126 may be mounted in the same location as the fan blades 122, i.e., one or more counterweights 126 may in effect replace one or more corresponding fan blades 122.

In an example, the counterweight 126 may be attached to or engaged with the base plate 118 in manner that allows the position and/or orientation of the counterweight 126 to be adjustable relative to the base plate 118. For example, counterweight 126 may include a protrusion that is inserted into a slot or hole of the base plate 118 and allows the counterweight 126 to be slid toward or away from the center of the base plate 118 and/or rotated to different angular positions on the base plate 118.

As in the case of the (front or first) counterweight 106 described above, the (rear or second) counterweight(s) 126 are configured to reduce or eliminate force imbalances created by the fluid pump 100 during operation. In some examples, the (rear or second) counterweight(s) 126 provide a counterbalancing effect that is sufficient to allow the (front or first) counterweight 106 to be eliminated. In other examples, such as illustrated in FIG. 1, the fluid pump 100 includes both the front or first) counterweight 106 and the (rear or second) counterweight(s) 126. This latter configuration may be useful for achieving a two-plane or dynamic balance by reacting both radial force imbalance and moment imbalance (by making sure that the sum of the forces and also the sum of the moments are zero). One or both of the (front or first) counterweight 106 and the (rear or second) counterweight(s) 126 may be configured to ensure that after they are mounted in the fluid pump 100, they are properly angularly aligned with each other. For example, one or both of the (front or first) counterweight 106 and the (rear or second) counterweight(s) 126 may include alignment features, such as a key or corresponding keyway, a pin or corresponding pin hole, flat surfaces, etc., as appreciated by persons skilled in the art.

In an example, in addition to providing the counterweight(s) 126, the force balancing effect of the connector 110 may be further tuned or adjusted by removing material from and/or adding material (other than the counterweight(s) 126) to the base plate 118 itself, as described further below.

Generally, no limitation is placed on the material composition of the connector 110 or its individual components. Various metals, metal alloys, metalloids, ceramics, and plastics/polymers may be suitable for the connector 110. The connector 110 may include a combination of two or more different classes of materials. As one example, the hub 114, the base plate 118, and the fan blades 122 may be composed of a plastic while the counterweight(s) 126 are composed of a metal.

In some embodiments, the cooling system of the fluid pump 100 additionally may be configured to carry heat energy away from the pump head 104. For example, the cooling system may include one or more fans 176, one or more internal air passages, and one or more vents (e.g., vent(s) 132) serving as inlets or outlets. One or more fans 176 are positioned in one or more appropriate locations for establishing one or more flow paths for drawing ambient air into the fluid pump 100, routing the air to pick up and carry heat energy away from the pump head 104, and exhausting the heated air from the fluid pump 100. In the illustrated example, the fan 176 is mounted in an interior region of the cowling 128, and includes its own motor for driving its fan blades. Alternatively, the fan 176 (or an additional fan 176) may be located on the rear (inlet) side of the pumping stage 144, and may be coupled to and thus powered by the drive shaft 112. In addition, the cooling system may include cooling fins (not shown) provided on various internal and/or external surfaces of the fluid pump 100.

Figure 2:
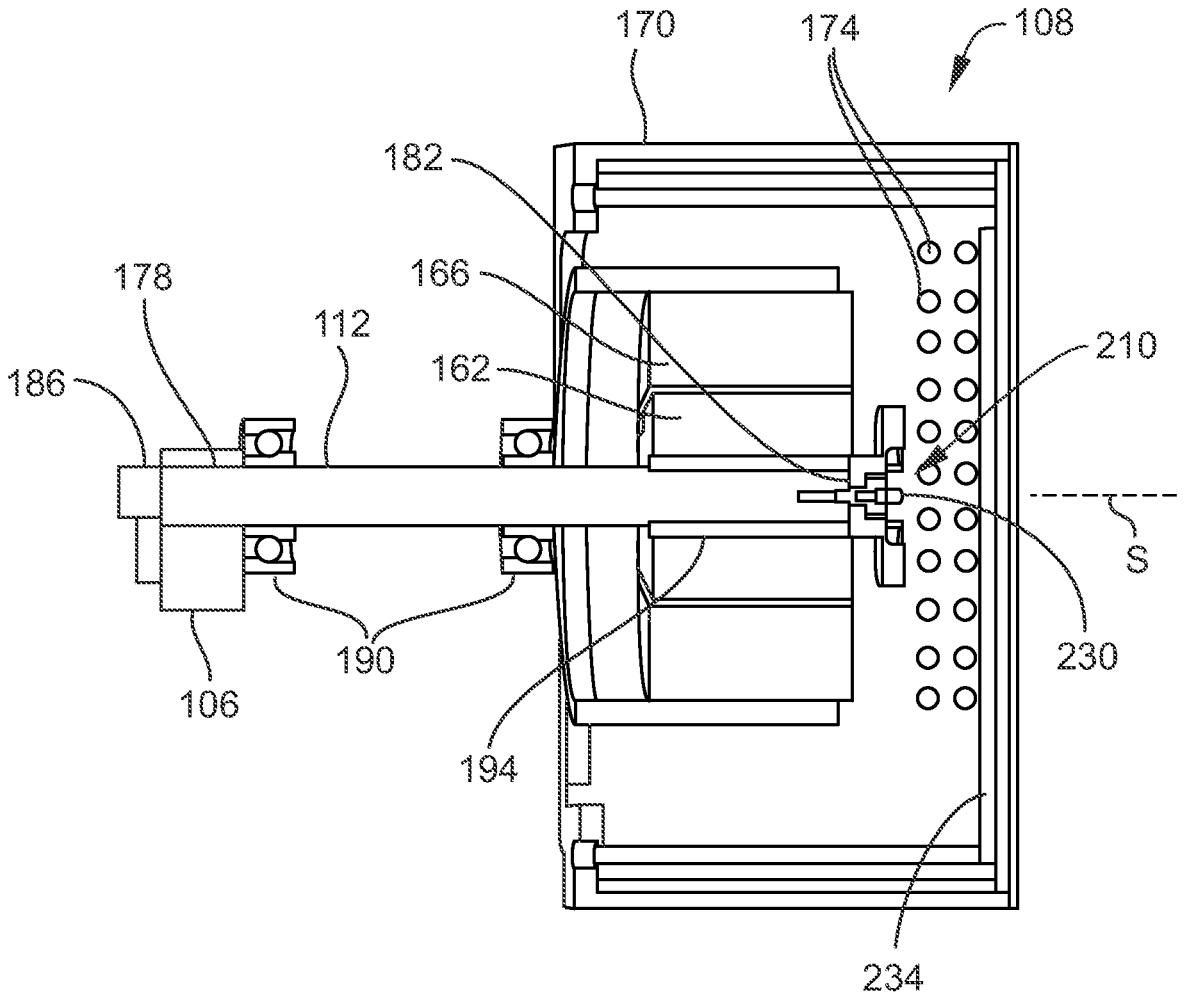
FIG. 2 is a cross-sectional, longitudinal side view of an example of a connector, showing the connector coupled to a drive shaft inside of a motor housing of a fluid pump, according to an embodiment of the present disclosure.
Figure 3A:
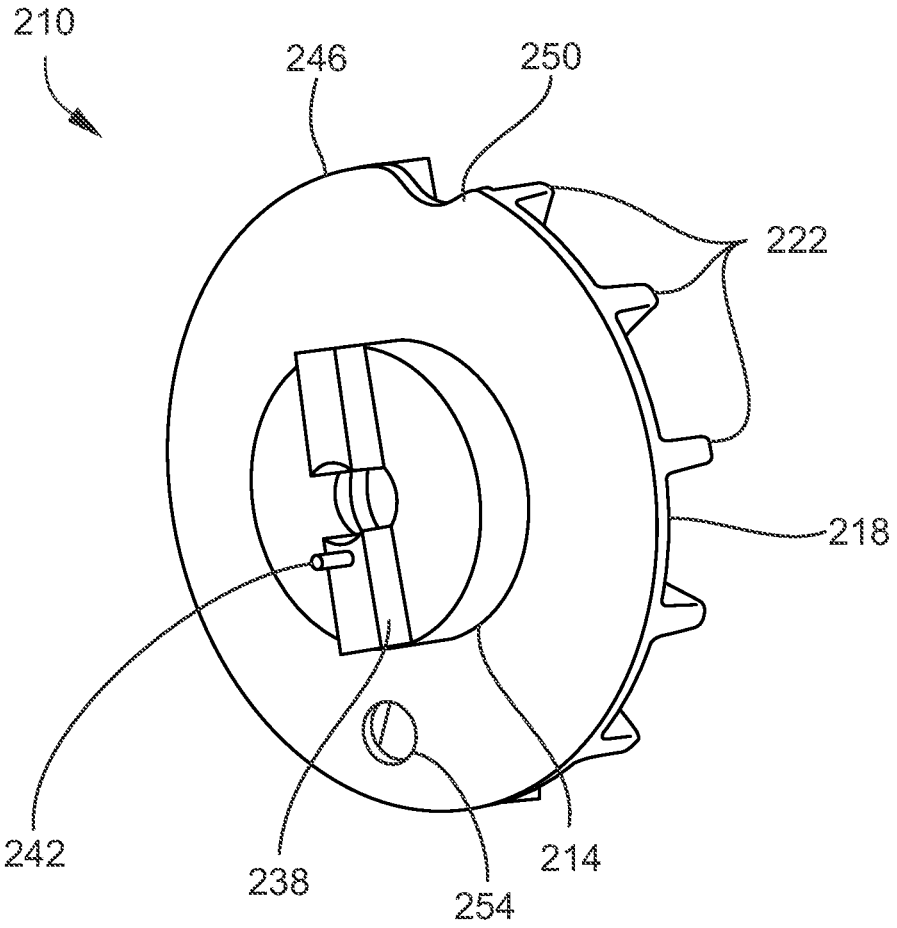
FIG. 3A is a front perspective view of the connector illustrated in FIG. 2.
Figure 3B:
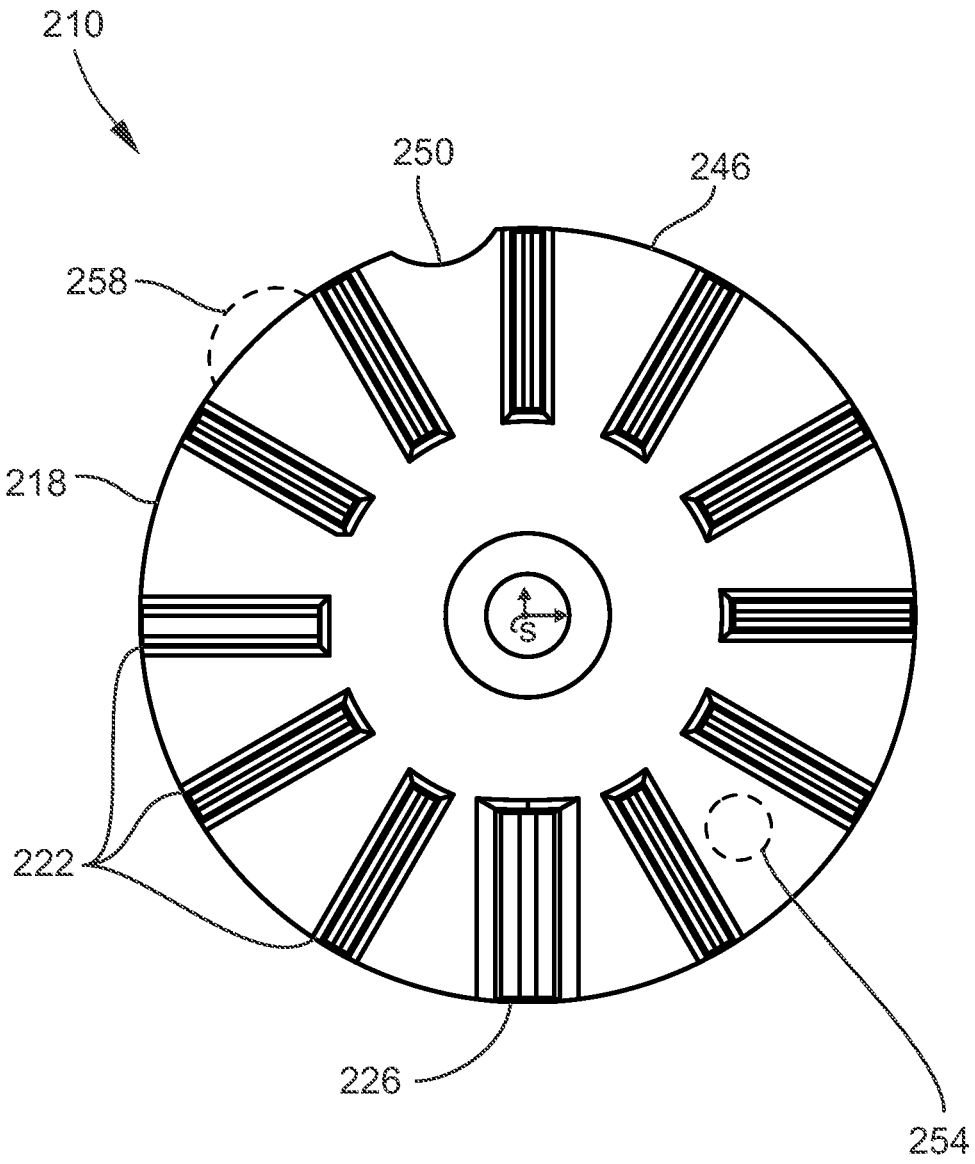
FIG. 3B is a rear plan view of the connector illustrated in FIG. 2.

FIGS. 2 to 3B illustrate an example of a connector 210 according to another embodiment. Specifically, FIG. 2 is a cross-sectional, longitudinal side view (along the drive axis S) of the connector 210, and also showing the connector 210 coupled to the drive shaft 112 inside of the motor housing 170. FIG. 3A is a front perspective view of the connector 210, and FIG. 3B is a rear plan view of the connector 210.

As in the case of the connector 110 described above and illustrated in FIG. 1, the connector 210 of the present example includes a hub 214, a base plate 218, a plurality of fan blades 222, and one or more (rear or second) counterweights 226. In the present example, the fan blades 222 extend axially outwardly from the base plate 218.

As shown in FIG. 2, in the present example, the connector 210 is securely fastened to the drive shaft 112 by engaging a bolt 230 to the drive shaft 112 such that the connector 210 is clamped between the head of the bolt 230 and the rear shaft end 182 of the drive shaft 112. Specifically, the outer thread of the bolt 230 mates with an inner thread of the drive shaft 112. FIG. 2 also shows a motor control board 234 (e.g., a printed circuit board, or PCB) positioned in the interior of the motor housing 170. The motor control board 234 may include electrical circuitry configured for directly receiving the electrical power supplied by an external power source, and regulating and varying the level of power transferred to the motor rotor 162 or motor stator 166 as needed to obtain a desired angular speed of the drive shaft 112, as appreciated by persons skilled in the art. In this example, the cooling air flow established by the fan blades 222 is effective for cooling heat-generating components of the motor control board 234, such as integrated circuit (IC) chips, transformers, transistors, etc., and/or for removing heat energy from any heat sink that may be provided on the motor control board 234.

As shown in FIG. 3A, in the present example, the hub 214 may include one or more keys 238 (e.g., bars, bosses, etc.) that extend in an axial direction away from the base plate 218. The key(s) 238 are configured to fit into corresponding keyway(s) (e.g., slot(s), groove(s), etc., not shown) of the motor-side bearing 194 and/or the rear shaft end 182 of the drive shaft 112. The hub 214 may further include one or more pins or posts 242 that extend in an axial direction away from the key(s) 238 (as illustrated), or alternatively away from the base plate 218. The pin(s) 242 are configured to fit into corresponding holes(s) (not shown) of the rear shaft end 182 of the drive shaft 112. The key(s) 238 and pin(s) 242 may assist in ensuring proper angular alignment of the connector 110 (particularly the counterweight(s) 226) with the other (front or first) counterweight 106 (if provided).

As shown in FIGS. 3A and 3B, in the present example, the fan blades 222 are arranged on the base plate 218 such that they are circumferentially spaced (i.e., at arcuate distances) from each other at a radial distance from the center of the base plate 218. In addition, the fan blades 222 are oriented along radial directions relative to the center of the base plate 218, and extend outwardly in an axial direction from the base plate 218. As shown in FIG. 3B, in the present example, a single counterweight 226 is provided, although in other examples more than one counterweight 226 may be provided as described above. In the present example, the counterweight 226 generally has the same shape and orientation as the fan blades 222, and thus is configured to move air in the same way as or a similar way to the fan blades 222. The counterweight 226 has a larger size, and greater weight than the fan blades 222, which are some of the examples of properties or attributes noted above that contribute to shifting the center of mass of the connector 210 away from its central axis or geometric center. As further examples, the counterweight 226 and the fan blades 222 may be composed of the same material or different materials as needed for providing effective counterbalancing in a given embodiment of the fluid pump 100. As noted above, in an example, the counterweight 226 may be removed from the base plate 218 and replaced with another counterweight 226, which may be different from the previous counterweight 226 as to size, shape, orientation, material, etc. In addition, in an example, the fan blades 222 also may be removed from the base plate 218 to enable one or more of the fan blades 222 to be replaced with one or more additional counterweights 226.

As noted above, the force balancing effect of the connector 110 may be further tuned or adjusted by removing material from and/or adding material (other than the counterweight(s) 126) to the base plate 118, thereby further adjusting the position of the center of mass of the base plate 118 (and thus overall connector 110) as needed to achieve a desired counterbalancing effect. In an example best shown in FIG. 3B, the base plate 118 has an outer perimeter 246 and a geometrical center (corresponding to the drive axis S). As an example of material removal, the outer perimeter 246 of the base plate 118 may be modified (e.g., engineered by a technique appropriate for the material, e.g., machining of metal, injection molding of plastic, etc.) to include one or more recesses 250 that extend generally in a radial direction from the outer perimeter 246 toward the base plate center. In the context of this disclosure, such a recess 250 may be considered to be a "concave" feature. Additionally or alternatively, one or more holes 254 may be formed (e.g., drilled) through part of the thickness of the base plate 118 (i.e., a blind hole) or through the entire thickness of the base plate 118 (i.e., a through-hole), as indicated by a dashed circle in FIG. 3B. As an example of material addition, the outer perimeter 246 of the base plate 118 may be modified to include one or more protrusions 258 that extend generally in a radial direction from the outer perimeter 246 away from the base plate center, as indicated by a curved dashed line in FIG. 3B. In the context of this disclosure, such a protrusion 258 may be considered to be a "convex" feature. All such cases of modification of the outer perimeter 246 may be described as rendering the shape of the outer perimeter 246 "irregular," i.e., the modified outer perimeter 246 is not a perfect or symmetrical geometrical shape (e.g., circle, polygon, etc.).

Figure 4:
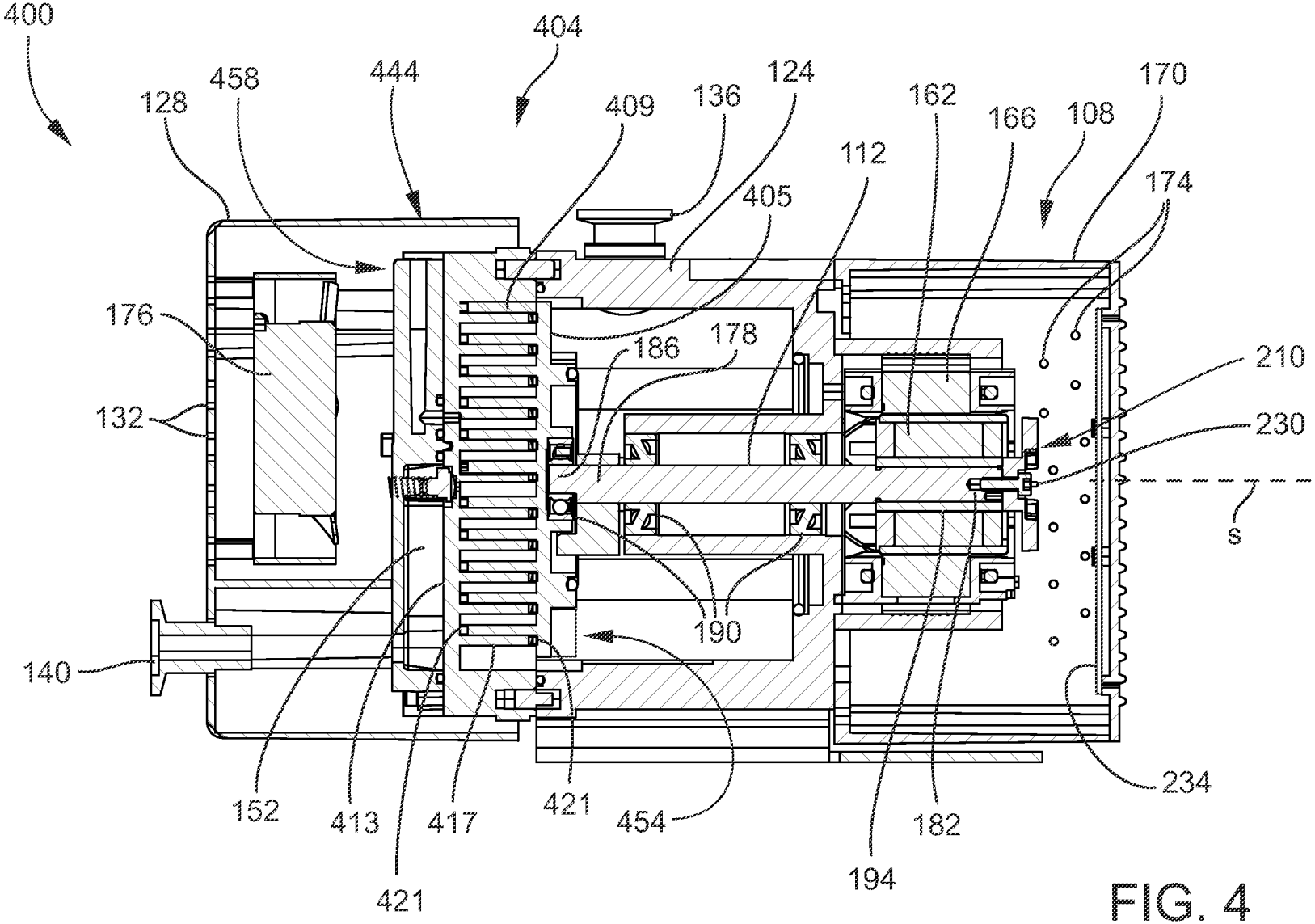
FIG. 4 is a cross-sectional, longitudinal side view of an example of a fluid pump configured as a scroll pump, according to another embodiment of the present disclosure.

FIG. 4 is a cross-sectional, longitudinal side view of an example of a scroll pump 400 according to another embodiment. The scroll pump 400 may be configured as a vacuum pump or a compressor.

The scroll pump 400 includes a pump head 404 with a pumping stage 444 in which the movable pump element is in the form of an orbiting plate scroll 454 and the pump stator is in the form of stationary plate scroll 458. The orbiting plate scroll 454 orbits around the drive axis S relative to the stationary plate scroll 458 in the manner described above. Specifically, the orbiting plate scroll 454 includes an orbiting plate 405 that orbits in the transverse plane (orthogonal to the drive axis S as described above). The orbiting plate scroll 454 further includes an orbiting scroll blade 409 that extends (or projects) axially in the direction from the orbiting plate 405 toward the stationary plate scroll 458. The stationary plate scroll 458 includes a stationary plate 413, and a stationary scroll blade 417 that extends (or projects) axially in the direction from the stationary plate 413 toward the orbiting plate scroll 454.

The orbiting scroll blade 409 and the stationary scroll blade 417 are shaped as spirals (i.e., run along a spiral path) in the transverse plane, as appreciated by persons skilled in the art. The cross-sectional view of FIG. 4 shows the several turns or wraps of the spiral-shaped orbiting scroll blade 409 and stationary scroll blade 417. As illustrated, the orbiting scroll blade 409 is juxtaposed with the stationary scroll blade 417 in the radial direction (relative to the drive axis S or device axis), such that the orbiting scroll blade 409 and the stationary scroll blade 417 are nested together with a clearance and a predetermined relative angular positioning. By this configuration, one or more pockets are defined in the pumping stage 444 by (and between) the nested orbiting scroll blade 409 and stationary scroll blade 417. The volume(s) of the pocket(s) vary as the orbiting scroll blade 409 orbits relative to the stationary scroll blade 417. Consequently, the working fluid is drawn into the pump inlet 136, through the pumping stage(s) 444, and to the pump outlet 140. In the pumping stage(s) 444, the working fluid is compressed in and by the pocket(s) as their volume(s) are reduced during one or more portions of the orbiting cycle of the orbiting plate scroll 454.

The axial tips of the orbiting scroll blade 409 and the stationary scroll blade 417 each may include a groove 525 (FIG. 5) in which a tip seal 421 is seated. Thus, the tip seal 421 runs along the same spiral path as the orbiting scroll blade 409 or the stationary scroll blade 417. The tip seal 421 of the orbiting plate scroll 454 is positioned between the orbiting scroll blade 409 and the stationary plate 413, and contacts the stationary plate 413 to thereby create an axial seal between the orbiting scroll blade 409 and the stationary plate 413. The tip seal 421 of the stationary plate scroll 458 is positioned between the stationary scroll blade 417 and the orbiting plate 405, and contacts the orbiting plate 405 to thereby create an axial seal between the stationary scroll blade 417 and the orbiting plate 405. The tip seals 421 are typically composed of a plastic.

The orbiting plate scroll 454 is an example of a pump component that creates a force imbalance during operation due to its orbiting motion. In the present example, this may be addressed by providing a connector as described herein, such as the connector 210 described above and illustrated in FIGS. 2 to 3B. The (front or first) counterweight 106 may additionally be provided, as illustrated in FIG. 4 and as described above.

Figure 5:
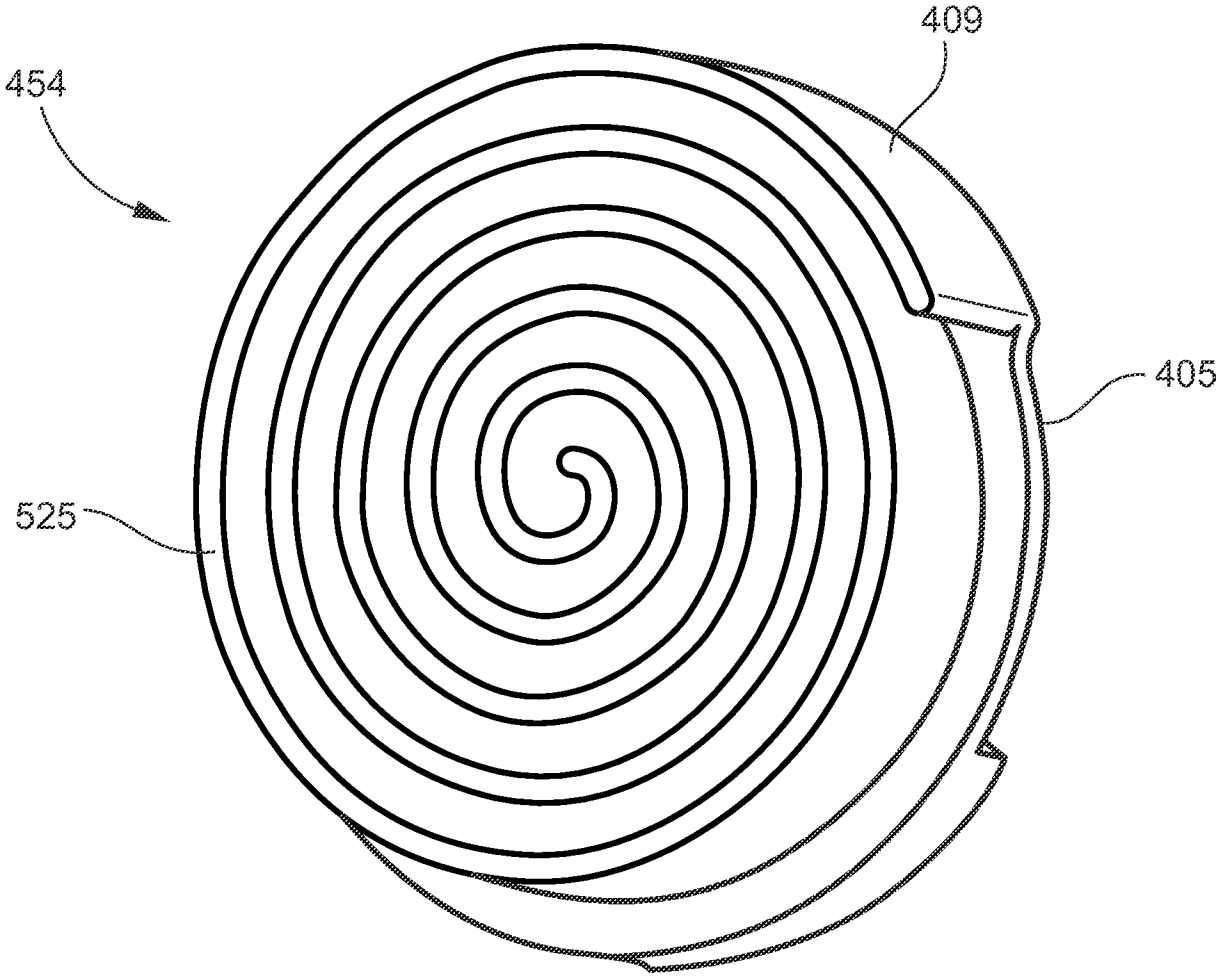
FIG. 5 is a perspective view of an example of an orbiting plate scroll that may be provided in the scroll pump illustrated in FIG. 4, according to an embodiment of the present disclosure.

FIG. 5 is a perspective view of an example of the orbiting plate scroll 454. In particular, FIG. 5 shows the spiral shape of the orbiting scroll blade 409. The spiral shape of the stationary scroll blade 417 may be the same or similar. FIG. 5 also shows the spiral groove 525 formed at the tip of the orbiting scroll blade 409, in which the tip seal 421 is seated as described above.

Scroll pumps are further described in, for example, U.S. Pat. No. 9,341,186 and U.S. Patent Application Pub. No.

2015/0078927, the entire contents of each of which are incorporated by reference herein.

It will be understood that terms such as "communicate with" and "in . . . communication with" (for example, a first component "communicates with" or "is in communication with" a second component), as well as "coupled to" or "coupled with," are used herein to indicate a structural, functional, mechanical, electrical, signal, optical, magnetic, electromagnetic, ionic or fluidic relationship between two or more components or elements. As such, the fact that one component is said to communicate with or be coupled to/with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A fluid pump, comprising:

a pump head comprising a pump inlet, a pump outlet, and a pumping stage comprising a movable pump element, wherein the pumping stage is configured to pump a fluid from the pump inlet to the pump outlet in response to movement of the movable pump element;

a motor comprising a motor rotor a motor stator, and a motor housing enclosing the motor rotor and the motor stator;

a drive shaft comprising a front shaft end and a rear shaft end, wherein the front shaft end is coupled to the movable pump element, the rear shaft end is coupled to the motor rotor, the motor rotor is configured to drive rotation of the drive shaft about a drive axis, and the drive shaft is configured to drive movement of the movable pump element; and a connector coupling the motor rotor and the rear shaft end, wherein the connector comprises a plate rotatable about the drive axis, a plurality of fan blades attached to the plate and configured to establish a flow of ambient air through the motor housing, and a counterweight attached to the plate.

2. The fluid pump of claim 1, wherein the counterweight has a larger weight than each of the fan blades.

3. The fluid pump of claim 1, wherein the counterweight has a configuration according to at least one of the following:

at least a portion of the counterweight has a fan blade-shaped configuration;

the counterweight is removably attached to the plate;

the counterweight is engaged with the plate such that a position of the counterweight on the plate is adjustable.

4. The fluid pump of claim 1, wherein the plate has an outer perimeter and a center, and the plate includes a recess at the outer perimeter extending inwardly toward the center.

5. The fluid pump of claim 1, wherein the plate has an outer perimeter and a center, and the plate comprises a protrusion at the outer perimeter extending outwardly from the center.

6. The fluid pump of claim 1, wherein the motor comprises a bearing positioned between the motor stator and the motor rotor, and the connector engages the bearing.

7. The fluid pump of claim 1, comprising a front counterweight attached to the drive shaft at a position between the pump head and the motor, wherein the counterweight attached to the plate is a rear counterweight.

8. The fluid pump of claim 1, wherein the movable pump element comprises an orbiting pump element configured to move in an orbiting manner around the drive axis in response to rotation of the drive shaft.

9. The fluid pump of claim 8, comprising an eccentric member positioned in eccentric relation to the drive shaft, and the movable pump element is coupled to the eccentric member.

10. The fluid pump of claim 1, wherein:

the movable pump element comprises an orbiting scroll blade;

the pumping stage comprises a stationary scroll blade nested with the orbiting scroll blade; and the orbiting scroll blade is configured to move in an orbiting manner relative to the stationary scroll blade in response to rotation of the drive shaft, to create at least one moving pocket between the orbiting scroll blade and the stationary scroll blade effective to pump fluid.

11. The fluid pump of claim 10, comprising an eccentric member positioned in eccentric relation to the drive shaft and configured to move in an orbiting manner in response to rotation of the driven shaft, and the orbiting scroll blade is movable with the eccentric member.

12. The fluid pump of claim 1, wherein the movable pump element comprises a pump rotor configured to rotate about the drive axis.

13. A method for operating a fluid pump, the method comprising:

providing the fluid pump according to claim 1; and rotating the connector and the drive shaft by operating the motor, wherein the drive shaft drives the movement of the movable pump element, and wherein, during the rotating, the counterweight reduces an imbalance in forces generated by the fluid pump, and the fan blades establish a flow of air around the motor that is effective to remove heat from the motor.

14. The method of claim 13, wherein the plate is a first plate, and further comprising replacing the first plate with a second plate having a different shape and/or weight than the first plate.

15. The method of claim 13, wherein the counterweight is a first counterweight, and further comprising replacing the first counterweight with a second counterweight having a different shape and/or weight than the first counterweight.

16. The method of claim 13, wherein the counterweight is a first counterweight, and further comprising attaching a second counterweight to the plate.

17. The method of claim 13, wherein the counterweight is a first counterweight, and further comprising replacing one of the fan blades with a second counterweight.

18. The fluid pump of claim 1, wherein the motor rotor has a front side facing toward the pump head and a rear side facing away from the pump head, and the connector is positioned at the rear side.

19. The fluid pump of claim 1, wherein the motor comprises a motor housing enclosing the motor rotor and the motor stator, and the fan blades are configured to establish a flow of ambient air through the motor housing.

20. A fluid pump, comprising:

a pump head comprising a pump inlet, a pump outlet, and a pumping stage comprising a movable pump element, wherein the pumping stage is configured to pump a fluid from the pump inlet to the pump outlet in response to movement of the movable pump element;

a motor comprising a motor rotor and a motor stator, wherein the motor rotor has a front side facing toward the pump head and a rear side facing away from the pump head;

a drive shaft comprising a front shaft end and a rear shaft end, wherein the front shaft end is coupled to the movable pump element, the rear shaft end is coupled to the motor rotor, the motor rotor is configured to drive rotation of the drive shaft about a drive axis, and the drive shaft is configured to drive movement of the movable pump element; and a connector coupling the motor rotor and the rear shaft end, wherein the connector is positioned at the rear side of the motor rotor and comprises a plate rotatable about the drive axis, a plurality of fan blades attached to the plate, and a counterweight attached to the plate.

* * * * *